United States Patent [19]

Fischer et al.

[11] Patent Number: 4,738,766

[45] **Date of Patent: * Apr. 19, 1988**

[54] PRODUCTION OF HIGH OCTANE GASOLINE

[75] Inventors: Ronald H. Fischer, Cherry Hill; Rene B. LaPierre, Medford; Peter J. Owens, Mantua; Philip Varghese, Voorhees, all of N.J.

[73] Assignee: Mobil Oil Corporation, New York, N.Y.

[ * ] Notice: The portion of the term of this patent subsequent to Jun. 30, 2004 has been disclaimed.

[21] Appl. No.: 940,382

[22] Filed: Dec. 10, 1986

Related U.S. Application Data

[63] Continuation-in-part of Ser. No. 825,294, Feb. 3, 1986, Pat. No. 4,676,887, which is a continuation-in-part of Ser. No. 740,677, Jun. 3, 1985, abandoned.

[51] Int. Cl.[4] ..... C10G 47/02; C10G 65/12

[52] U.S. Cl. ..... 208/68; 208/69; 208/74; 208/89; 208/111

[58] Field of Search ..... 208/50, 61, 67, 70, 208/68, 89, 74, 111, 97, 69

[56] References Cited

U.S. PATENT DOCUMENTS

| | | | |
|---|---|---|---|
| 3,287,254 | 11/1966 | Paterson | 208/68 |
| 3,867,277 | 2/1975 | Ward | 208/111 |
| 3,869,378 | 3/1975 | Pollock et al. | 208/68 |
| 4,302,323 | 11/1981 | Chen | 208/89 |
| 4,332,670 | 6/1982 | Antal | 208/68 |
| 4,426,276 | 1/1984 | Dean et al. | 208/60 |
| 4,585,545 | 4/1986 | Yancey, Jr. et al. | 208/68 |
| 4,676,887 | 6/1987 | Fischer et al. | 208/61 |

*Primary Examiner*—Helen M. S. Sneed
*Assistant Examiner*—Anthony McFarlane
*Attorney, Agent, or Firm*—Alexander J. McKillop; Michael G. Gilman; Malcolm D. Keen

[57] ABSTRACT

A moderate pressure hydrocracking process in which a highly aromatic, substantially dealkylated feedstock having a boiling point in the range between 300° and 650° F. is processed directly to high octane gasoline by hydrocracking over a catalyst, preferably comprising a large pore size, crystalline alumino-silicate zeolite hydrocracking catalyst such as zeolite Y together with a hydrogenation-dehydrogenation component. The feedstock which is preferably a light cut light cycle oil has an aromatic content of at least 50, usually at least 60 percent and an API gravity not more than 25. The hydrocracking typically operates at 600–1000 psig at moderate to high conversion levels to maximize the production of monocyclic aromatics which provide the requisite octane value to the product gasoline.

23 Claims, 1 Drawing Sheet

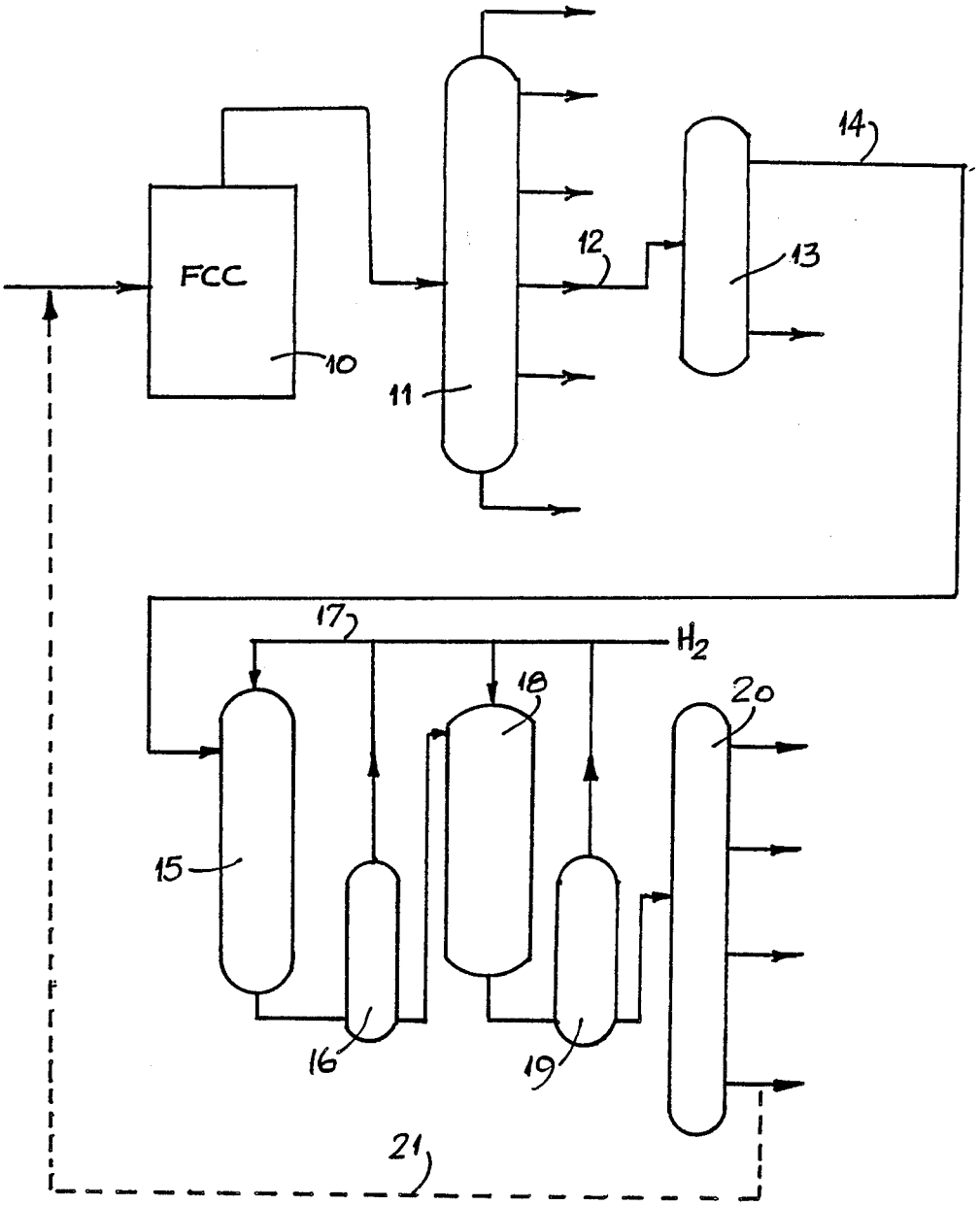
FCC
10
11
12
13
14
15
16
17
18
19
20
21
$H_2$

PRODUCTION OF HIGH OCTANE GASOLINE

CROSS REFERENCE TO RELATED PATENT APPLICATIONS

This application is a continuation-in-part application to U.S. patent application Ser. No. 825,294, filed Feb. 3, 1986 in the name of R. H. Fischer et al, now U.S. Pat. No. 4,676,887, which is a continuation-in-part application to U.S. patent application Ser. No. 740,677, filed June 3, 1985 in the name of R. H. Fischer et al, now abandoned. The subject matter of both these prior applications is incorporated in the present application.

FIELD OF THE INVENTION

This invention relates to the production of high octane gasoline and more particularly to the production of high octane gasoline by hydrocracking highly aromatic fractions obtained from catalytic cracking operations.

BACKGROUND OF THE INVENTION

Under present conditions, petroleum refineries are finding it necessary to convert increasingly greater proportions of crude to premium fuels such as gasoline and middle distillates such as diesel and jet fuel. Catalytic cracking processes, exemplified by the fluid catalytic cracking (FCC) process and Thermofor catalytic cracking (TCC) process together, account for a substantial fraction of heavy liquids conversion in modern refineries. Both are thermally severe processes which result in a rejection of carbon to coke and to residual fractions; during catalytic cracking high molecular weight liquids disproportionate into relatively hydrogen-rich light liquids and aromatic, hydrogen-deficient heavier distillates and residues.

Catalytic cracking in the absence of hydrogen does not provide significant desulfurization nor is the nitrogen content of the feed selectively rejected with the coke. Both sulfur and nitrogen therefore concentrate appreciably in the heavier cracking products. Cracking therefore produces significant quantities of highly aromatic, hydrogen-deficient middle and heavy distillates that have high sulfur and nitrogen levels. Recycling these liquids to the catalytic cracker is often not an attractive option, because they are refractory and difficult to convert and often will impair conversion of the less refractory fresh feed. Generally, the level of heteroatom contaminants increases with the boiling point of the fraction, as shown in Table 1 below which gives the sulfur and nitrogen contents for two typical FCC product fractions, a light cycle oil and an FCC main column bottoms (proportions and percentages by weight, as in the remainder of this specification unless the contrary is stated).

TABLE 1

| | FCC Product Fractions | | | |
|---|---|---|---|---|
| | Aromatics, pct. | S, pct. | N, ppm | H, pct. |
| Light Cycle Oil | 80 | 3.1 | 650 | 9.1 |
| Main Column Bottoms | 80+ | 4.6 | 1500 | 6.8 |

Present market requirements make refractory product streams such as these particularly difficult to dispose of as commercially valuable products. Formerly, the light and heavy cycle oils could be upgraded and sold as light or heavy fuel oil, such as No. 2 fuel oil or No. 6 fuel oil. Upgrading the light cycle oil was conventionally carried out by a relatively low severity, low pressure catalytic hydro-desulfurization (CHD) unit in which the cycle stock would be admixed with virgin mid-distillates from the same blend fed to the catalytic cracker. Further discussion of this technology is provided in the *Oil and Gas Journal,* May 31, 1982, pp. 87–94.

Currently, however, the refiner is finding a diminished demand for fuel oil. At the same time, the impact of changes in supply and demand for petroleum has resulted in a lowering of the quality of the crudes available to the refiner; this has resulted in the formation of an even greater quantity of refractory cycle stocks. As a result the refiner is left in the position of producing increased amounts of poor quality cycle streams from the catalytic cracker while having a diminishing market in which to dispose of these streams.

At many petroleum refineries, the light cycle oil (LCO) from the FCC unit is a significant component of the feed to the catalytic hydrodesulfurization (CHD) unit which produces No. 2 fuel oil or diesel fuel. The remaining component is generally virgin kerosene taken directly from the crude distillation unit. The highly aromatic nature of LCO, particularly when the FCC unit is operated in the maximum gasoline mode, increases operational difficulties for the CHD and can result in a product having marginal properties for No. 2 fuel oil or diesel oil, as measured by cetane numbers and sulfur content.

An alternative market for mid-distillate streams is automotive diesel fuel. However, diesel fuel has to meet a minimum cetane number specification of about 45 in order to operate properly in typical automotive diesel engines. Because cetane number correlates closely and inversely with aromatic content, the highly aromatic cycle oils from the cracker typically with aromatic contents of 80% or even higher have cetane numbers as low as 4 or 5. In order to raise the cetane number of these cycle stocks to a satisfactory level by the conventional CHD technology described above, substantial and uneconomic quantities of hydrogen and high pressure processing would be required.

Because of these problems associated with its use as a fuel, recycle of untreated light cycle oil to the FCCU has been proposed as a method for reducing the amount of LCO. Benefits expected from the recycle of LCO include conversion of LCO to gasoline, backout of kerosene from No. 2 fuel oil and diminished use of cetane improvers in diesel fuel. However, in most cases, these advantages are outweighed by disadvantages, which include increased coke make in the FCC unit, diminished quality of the resultant LCO and an increase in heavy cycle oil and gas.

A typical LCO is such a refractory stock and of poor quality relative to a fresh FCC feed that most refineries do not practice recycle of the untreated LCO to any significant extent. One commonly practiced alternative method for upgrading the LCO is to hydrotreat severely prior to recycle to the catalytic cracker or, alternatively, to hydrotreat severely and feed to a high pressure fuels hydrocracker. In both such cases, the object of hydrotreating is to reduce the heteroatom content to low levels while saturating polyaromatics to increase crackability. Although this does enhance the convertibility of these aromatic streams considerably, the economic penalties derived from high hydrogen consumptions and high pressure processing are severe. In addition, in those instances where the production of gasoline is desired, the naphtha may require reforming to recover its aromatic character and meet octane specifications.

Hydrocracking may be used to upgrade the higher-boiling more refractory products derived from catalytic cracking. The catalytic cracker is used to convert the more easily cracked paraffinic gas oils from the distillation unit while the hydrocracker accepts the dealkylated, aromatic cycle oils from the cracker and hydrogenates and converts them to lighter oils. See Petroleum Refining; Second Ed.; Gary, J. H. and Handwerk, G. E.; Marcel Dekker, N.Y. 1984; pp. 138–151; Modern Petroleum Technology, Fourth Ed.; Hobson, G. D., Applied Science Publ. 1973; pp. 309–327. These hydrocracking processes using catalytically cracked feeds either on their own or mixed with virgin feeds have, however, generally been incapable of producing high octane gasoline directly. The reason for this is that they have conventionally been operated at high hydrogen pressures and at relatively high conversion levels so as to maximize the saturation of the aromatics (especially the refractory polynuclear aromatics), removal of heteroatoms in inorganic form and the subsequent conversion of the hydrogenated aromatics to paraffins. While this may produce acceptable diesel fuel (which benefits from the presence of n-paraffins) the octane quality of the gasoline has generally been poor as a consequence of the large quantities of low octance paraffin components. For present day use these gasolines will require extensive reforming with its consequent yield loss in order to conform to market product specifications. To illustrate, U.S. Pat. No. 3,132,090 discloses the use of a two-stage hydrocracking scheme to produce gasoline. However, the octane number of the gasoline using a virgin distillate as charge is reported as 68 (RON+0). An octane of 80 (RON+3) is disclosed for a charge-stock of coker distillate and thermally cracked gas oils. The "high octaine" gasolines described in this patent contain 3 ml/gallon of tetraethyl lead (TEL) and are in the range of 70–88 (RON+3). Because TEL adds about 4–6 octane numbers these gasolines have an octane rating on a clear basis (RON+0) in the range of 65–83 (RON+0).

Various low pressure hydrocracking processes have also been described. For example, U.S. Pat. Nos. 3,867,277 and 3,923,640 disclose low pressure hydrocracking processes using various high boiling feedstocks, generally of high (20–40) API gravity. The use of such feeds, coupled with the relatively high levels of conversion in those processes leads to naphthas of low octane rating since the alkyl groups present in the feeds come through into the naphtha together with the relatively straight chain paraffins produced by the ring opening and cracking of the aromatics. These processes have therefore been unsatisfactory for the direct production of high octane gasoline.

Other low pressure hydrocracking processes producing aromatic products have been described in the past but their potential for producing high octane gasoline from low value, refractory cracking oils has not been appreciated. For example, U.S. Pat. No. 4,435,275 describes a method for producing aromatic middle distillates such as home heating oil from high gravity feeds under relatively low conversion conditions but with the objective of producing low-sulfur middle distillates, octane numbers of only about 78 (R+0) are reported.

A notable advance is described in patent application Ser. No. 825,294 to which reference is made for details. It was found that highly aromatic, refractory feeds derived from catalytic cracking could be converted directly to high octane gasoline by hydrocracking at relatively low pressures, typically 600–1000 psig (about 4250–7000 kPa. abs.) and with low conversions, typically below 50 weight percent to 385° F.–(195° C.–) products. (All SI equivalents in this specification are rounded off to a convenient figure so as to permit convenient comparison; all pressures quoted in SI units are absolute pressures). By using a highly aromatic feed which has been substantially dealkylated in the catalytic cracking operation, typically with an API gravity of 5–25, the hydrocracking proceeds with only a limited degree of aromatics saturation so that a large quantity of single-ring alkylaromatics (mainly benzene, toluene, xylenes and trimethyl benzenes) are obtained by ring opening of partial hydrogenation products of bicyclic aromatics. The single ring aromatics are not only in the gasoline boiling range but also possess high octane numbers so that a high octane gasoline is produced directly, suitable for blending into the refinery gasoline pool without prior reforming.

SUMMARY OF THE INVENTION

The present invention is related to the invention described in application Ser. No. 825,294. In that application, the feed is a full boiling range fraction from a catalytic cracking operation, for example, a full range light cycle oil (LCO) or a heavy cycle oil (HCO). A typical full range light cycle oil (FRLCO) will have a boiling range of about 400°–750° F. (about 205°–400° C.). Using a full boiling range fraction of that kind, the conversion has to be held at relatively low levels—below 50% and preferably below a certain value related to the hydrogen partial pressure, both in order to produce a high octane gasoline product and to avoid excessive catalyst aging. Although the attainment of high gasoline octane in this way is extremely advantageous, the limitation on conversion represents a process limitation which should, if feasible, be transcended in order to maximize gasoline yield. The present invention enables higher levels of conversion to be employed so that high yields of high octane gasoline are produced directly from the feed in a single pass.

According to the present invention, the high octane gasoline is produced from a relatively lower boiling fraction of the aromatic feed from the catalytic cracking operation. By the use of these light cut feeds, conversion may be raised to higher levels without adversely affecting gasoline octane or catalyst aging rate.

The feed used in the hydrocracking is a highly aromatic, substantially dealkylated distillate feed wtih a maximum end point of about 750° F. (400° C.), preferably not more than 700° F. (about 370° C.), usually not more than about 650° F. (345° C.). As the end point of the feed is progressively lowered, the conversion may be raised to higher levels without incurring significant penalties. So, if the end point of the feed is lowered further, for instance, to 600° F. (315° C.) or even lower, conversion may be raised still further. Conversion to gasoline boiling range products will, however, be limited to an 85 percent by weight maximum and preferably will not exceed 65 percent by weight.

Suitable feeds comprise light cut light cycle oils, typically with boiling ranges of 300°–650° F. (150°–345° C.) with more restricted boiling range feeds from 330°-600° F. (165°-315° C.) or with higher initial boiling points, for example, in a 385°-600° F. (195°-315° C.) light cut LCO. These feeds may suitably be obtained by fractionation of a cycle oil from a catalytic cracking operation. The heavier fraction from the cycle oil (which is not passed to the hydrocracker) may be blended into fuel oil or passed to other refinery process units. The heteroatom contaminants in the cycle oil are concentrated in the heavier fractions and their removal from the hydrocracking step therefore reduces catalyst deactivation, leading to longer cycle life.

The hydrocracking is operated under low to moderate pressure, typically 400-1000 psig (about 2860-7000 kPa) hydrogen pressure. At the relatively low severity conditions employed temperatures will generally be in the range 600°-850° F. (315°-455° C.), more typically 700°-800° F. (370°-425° C.), with space velocity adjusted to obtain the desired conversion.

THE DRAWINGS

The single FIGURE of the accompanying drawings is a simplified schematic illustration of a process unit for producing gasoline by the present process.

DETAILED DESCRIPTION

Feedstock

The feeds used in the present process are hydrocarbon fractions which are highly aromatic and hydrogen deficient. They are fractions which have been substantially dealkylated, as by a catalytic cracking operation, for example, in an FCC or TCC unit. It is a characteristic of catalytic cracking that the alkyl groups, generally bulky, relatively large alkyl groups (typically but not exclusively $C_5$-$C_9$ alkyls), which are attached to aromatic moieties in the feed become removed during the course of the cracking. It is these detached alkyl groups which lead to the bulk of the gasoline product from the cracker. The aromatic moieties such as benzene, naphthalene, benzothiophenes, dibenzothiophenenes and polynuclear aromatics (PNAs) such as anthracene and phenanthrene form the high boiling products from the cracker. The mechanisms of acid-catalyzed cracking and similar reactions remove side chains of greater than 5 carbons while leaving behind short chain alkyl groups, primarily methyl, but also ethyl groups on the aromatic moieties. Thus, the "substantially dealkylated" cracking products include those aromatics with small alkyl groups, such as methyl, and ethyl, and the like still remaining as side chains, but with relatively few large alkyl groups, i.e., the $C_5$-$C_9$ groups, remaining. More than one of these short chain alkyl groups may be present, for example, one, two or more methyl groups.

Feedstocks of this type have an aromatic content in excess of 50 wt. percent; for example, 70 wt. percent or 80 wt. percent or more, aromatics. Highly aromatic feeds of this type typically have hydrogen contents below 14 wt. percent, usually below 12.5 wt. percent or even lower, e.g. below 10 wt. percent or 9 wt. percent. The API gravity is also a measure of the aromaticity of the feed, usually being below 30 and in most cases below 25 or even lower, e.g. below 20. In most cases the API gravity will be in the range 5 to 25 with corresponding hydrogen contents from 8.5-12.5 wt. percent. Sulfur contents are typically from 0.5-5 wt. percent and nitrogen from 50-1000 ppmw.

Suitable feeds for the present process are substantially dealkylated cracking product fractions with an end point below 650° F. (345° C.), preferably below 600° F. (315° C.). Initial boiling point will usually be 300° F. (150° C.) or higher, e.g. 330° F. (165°) or 385° F. (195° C.). Light cut light cycle oils (LCOs) within these boiling ranges are highly suitable. A full range light cycle oil (FRCO) generally has a boiling point range betwen 385° and 750° F. (195°-400° C.). Light cycle oils generally contain from about 60 to 80% aromatics and, as a result of the catalytic cracking process, are substantially dealkylated. Other examples of suitable feedstocks include the dealkylated liquid products from delayed or fluid bed coking processes.

The appropriate boiling range fraction may be obtained by fractionation of a FRCO or by adjustment of the cut points on the cracker fractionation column. The light stream will retain the highly aromatic character of the catalytic cracking cycle oils (e.g. greater than 50% aromatics by silica gel separation) but the light fractions used in the present process generally exclude the heavier polynuclear aromatics (PNAs—three rings or more) which remain in the higher boiling range fractions. In addition, the heteroatom contaminants are concentrated in the higher boiling fractions so that the present hydrocracking step is operated substantially in their absence.

The use of the dealkylated feeds is a significant feature of the process. It will not produce high octane gasoline from predominantly virgin or straight run oils and which have not been previously dealkylated by processes such as catalytic cracking or coking. If the feed used in the present process has not been previously dealkylated, the large alkyl groups found in the feed will be cracked off during the hydrocracking and will be found in the resulting naphtha fraction. Because these groups are relatively straight chain, a low octane gasoline product will result. Smaller, i.e., $C_1$-$C_3$, alkyl side groups, if present do not appear in the naphtha boiling range products from the hydrocracker (even if conditions are severe enough to remove them) and so they have no effect on product octane. If a mixture of dealkylated and non-dealkylated feedstock is used, the octane number will be intermediate between the octane numbers of the feeds used separately. A mixture of alkylated and dealkylated feedstocks can be used in commercial operation but if so, it is likely that the gasoline will have to be subjected to a reforming process in order to achieve the desired octane.

Catalysts

The catalyst used for the hydrocracking is a bifunctional, heterogeneous, porous solid catalyst possessing acidic and hydrogenation-dehydrogenation functionality. Because the highly aromatic feed contains relatively bulky bicyclic and polycyclic components the catalyst should have a pore size which is sufficiently large to admit these materials to the interior structure of the catalyst where cracking can take place. A pore size of at least about 7.4A (corresponding to the pore size of the large pore size zeolites X and Y) is sufficient for this purpose but because the end point of the feed is limited, the porportion of bulky, polynuclear aromatics is quite low and for this reason, very large pore sizes greatly exceeding those previously mentioned are not required. Crystalline zeolite catalysts which have a relatively limited pore size range, as compared to the so-called amorphous materials such as alumina or silica-alumina, may therefore be used to advantage in view of their activity and resistance to poisoning. Catalysts having aromatic selectivity, i.e. which will crack aromatics in preference to paraffins are preferred because of the highly aromatic character of the feed.

The preferred hydrocracking catalysts are the crystalline catalysts, generally the zeolites, and, in particular, the large pore size zeolites having a Constraint Index less than 2. For purposes of this invention, the term "zeolite" is meant to represent the class of porotectosilicates, i.e., porous crystalline silicates, that contain silicon and oxygen atoms as the major components. Other components are also present, including aluminum, gallium, oron, boron and the like, with aluminum being preferred in order to obtain the requisite acidity. Minor components may be present separately, in mixtures in the catalyst or intrinsically in the structure of the catalyst.

Zeolites with a silica-to-alumina mole ratio of at least 10:1 are useful, it is preferred to use zeolites having much higher silica-to-alumina mole ratios, i.e., ratios of at least 50:1. The silica-to-alumina mole ratio referred to may be determined by conventional analysis. This ratio is meant to represent, as closely as possible, the ratio in the rigid anionic framework of the zeolite crystal and to exclude aluminum in the binder or in cationic or other forms within the channels.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index and usually pores of large size, e.g., greater than 8 Angstroms. The method by which Constraint Index is determined is described fully in U.S. Pat. No. 4,016,218, to which reference is made for details of the method. A Constraint Index of less than 2 and preferably less than 1 is a characteristic of the hydrocracking catalysts used in the present process.

Constraint Index (CI) values for some typical large pore materials are shown in Table 2 below:

TABLE 2

| | Constraint Index |
|---|---|
| | CI (Test Temperature) |
| ZSM-4 | 0.5 (316° C.) |
| ZSM-20 | 0.5 (371° C.) |
| TEA Mordenite | 0.4 (316° C.) |
| Mordenite | 0.5 (316° C.) |
| REY | 0.4 (316° C.) |
| Amorphous Silica—Alumina | 0.6 (538° C.) |
| Dealuminized Y (Deal Y) | 0.5 (510° C.) |
| Zeolite Beta | 0.6–2 (316°–399° C.) |

The nature of the CI parameter and the technique by which it is determined admit of the possibility that a given zeolite can be tested under somewhat different conditions and thereby exhibit different Constraint Indices. Constraint Index may vary with severity of operation (conversion) and the presence or absence of binders. Other variables, such as crystal size of the zeolite, the presence of occluded contaminants, etc., may also affect the Constraint Index. It may be possible to so select test conditions, e.g., temperatures, as to establish more than one value for the Constraint Index of a particular zeolite, as with zeolite beta. A zeolite is considered to have a Constraint Index within the specified range if it can be brought into the range under varying conditions.

The large pore zeolites, i.e., those zeolites having a Constraint Index less than 2 have a pore size sufficiently large to admit the vast majority of components normally found in the feeds. These zeolites are generally stated to have a pore size in excess of 7 Angstroms and are represented by zeolites having the structure of e.g., Zeolite Beta, Zeolite X, Zeolite Y, faujasite, Ultrastable Y (USY), Dealuminized Y (Deal Y), Mordenite, ZSM-3, ZSM-4, ZSM-18 and ZSM-20. Zeolite ZSM-20 resembles faujasite in certain aspects of structure, but has a notably higher silica/alumina ratio than faujasite, as do the various forms of zeolite Y, especially USY and De-AlY. Zeolite Y is the preferred catalyst, and it is preferably used in one of its more stable forms, especially USY or De-AlY.

Although Zeolite Beta has a Constraint Index less than 2, it does not behave exactly like a typical large pore zeolite. Zeolite Beta satisfies the pore size requirements for a hydrocracking catalyst for use in the present process but it is not preferred because of its paraffin-selective behavior.

Because they are aromatic selective and have a large pore size, the amorphous hydrocracking catalysts such as alumina and silica-alumina may be used although they are not preferred.

Zeolite ZSM-4 is described in U.S. Pat. No. 3,923,639; Zeolite ZSM-20 in U.S. Pat. No. 3,972,983; Zeolite Beta in U.S. Pat. Nos. 3,308,069 and Re 28,341; Low sodium Ultrastable Y molecular sieve (USY) is described in U.S. Pat. Nos. 3,293,192 and 3,449,070; Dealuminized Y zeolite (Deal Y) may be prepared by the method found in U.S. Pat. No. 3,442,795; and Zeolite UHP-Y is described in U.S. Pat. No. 4,401,556. Reference is made to these patents for details of these zeolite catalysts.

The catalyst should have some acidity, i.e., an alpha value greater than 1 for the cracking function. The alpha value, a measure of zeolite acidic functionality, is described together with details of its measurement in U.S. Pat. No. 4,016,218 and in *J. Catalysis*, Vol. VI, pages 278–287 (1966) and reference is made to these for such details. However, because the catalyst is being used in a fixed bed operation with a highly aromatic feed at low hydrogen pressure, it must have a low coking tending in order to reduce aging and for this reason, a low alpha value is preferred. Alpha values between 1 and 200, preferably not more than 100 are preferred, with values not more than 75 e.g. 50 being useful.

Catalyst stability during the extended cycle life is essential and this may be conferred by suitable choice of catalyst structure and composition, especially silica:alumina ratio. This ratio may be varied by initial zeolite synthesis conditions, or by subsequent dealuminization as by steaming or by substitution of frame work aluminum with other trivalent species such as boron, iron or gallium. Because of its convenience, steaming is a preferred treatment. In order to secure satisfactory catalyst stability, high silica:alumina ratios, e.g. over 50:1 are preferred, e.g. about 200:1 and these may be attained by steaming. The alkali metal content should be held at a low value, preferably below 1% and lower, e.g. below 0.5% Na. This can be achieved by successive sequential ammonium exchange followed by calcination.

Improved selectivity and other beneficial properties may be obtained by subjecting the zeolite to treatment with steam at elevated temperatures ranging from 500° to 1200° F. (399°-538° C.), and preferably 750° to 1000° F. (260°-694° C.). The treatment may be accomplished in an atmosphere of 100% steam or an atmosphere consisting of steam and a gas which is substantially inert to the zeolites. A similar treatment can be accomplished by lower temperatures and elevated pressure, e.g. 350° to 700° F. (177°-371° C.) at 10 to about 200 atmospheres.

The zeolites are preferably composited with a matrix comprising another material resistant to the temperature and other conditions employed in the process. The matrix material is useful as a binder and imparts greater resistance to the catalyst for the severe temperature, pressure and reactant feed stream velocity conditions encountered in the process. Useful matrix materials include both synthetic and naturally occurring substances, such as clay, silica and/or metal oxides. The latter may be either naturally occurring or in the form of synthetic gelatinous precipitates or gels including mixtures of silica and metal oxides such as alumina and silica-alumina. The matrix may be in the form of a cogel. Naturally occurring clays which can be composited with the zeolite include those of the montmorillonite and kaolin families. Such clays can be used in the raw state as originally mined or initially subjected to calcination, acid treatment or chemical modification. The relative proportions of zeolite component and the matrix, on an anhydrous basis, may vary widely with the zeolite content ranging from between about 1 to about 99 wt %, and more usually in the range of about 5 to about 80 wt % of the dry composite. If the feed contains greater than 20% 650° F.+ material, that the binding matrix itself be an acidic material having a substantial volume of large pore size material, not less than 100 Å. The binder is preferably composited with the zeolite prior to treatments such as steaming,impregnation, exchange, etc., in order to preserve mechanical integrity and to assist impregnation with non-exchangeable metal cations.

The original cations associated with each of the crystalline silicate zeolites utilized herein may be replaced by a wide variety of other cations, according to conventional techniques. Typical replacing cations including hydrogen. ammonium and metal cations, including mixtures of these cations. Useful cations include metals such as rare earth metals, e.g., manganese, as well as metals of Group IIA and B of the Periodic Table, e.g., zinc, and Group VIII of the Periodic Table, e.g., platinum and palladium, to promote stability (as with the rare earth cations) or a desired functionality (as with the Group VI or VIII metals). Typical ion-exchange techniques are to contact the particular zeolite with a salt of the desired replacing cation. Although a wide variety of salts can be employed, particular preference is given to chlorides, nitrates and sulfates. Representative ion-exchange techniques are disclosed in a wide variety of patents, including U.S. Pat. Nos. 3,140,249; 3,140,251; and 3,140,253.

Following contact with a solution of the desired replacing cation, the zeolite is then preferably washed with water and dried at a temperature ranging from 150° to about 600° F. (65°-315° C.), and thereafter calcined in air, or other inert gas, at temperatures ranging from about 500° to 1500° F. (260°-815° C.) for periods of time ranging from 1 to 48 hours or more.

The hydrocracking catalyst also has a metal component to provide hydrogenation-dehydrogenation functionality. Suitable hydrogenation components include the metals of Groups VIA and VIIIA of the Periodic Table (IUPAC Table) such as tungsten, vanadium, zinc, molybdenum, rhenium, nickel, cobalt, chromium, manganese, or a noble metal such as platinum or palladium, in an amount between 0.1 and about 25 wt %, normally 0.1 to 5 wt % especially for noble metals, and preferably 0.3 to 3 wt %. This component can be exchanged or impregnated into the composition, using a suitable compound of the metal. The compounds used for incorporating the metal component into the catalyst can usually be divided into compounds in which the metal is present in the cation of the compound and compounds in which it is present in the anion of the compound. Compounds which contain the metal as a neutral complex may also be employed. The compounds which contain the metal in the ionic state are generally used, although cationic forms of the metal, e.g. $Pt(NH_3)_4^{2+}$, have the advantage that they will exchange onto the zeolite. Anionic complex ions such as vanadate or metatungstate which are commonly employed can however be impregnated onto the zeolite/binder composite without difficulty in the conventional manner since the binder is able to absorb the anions physically on its porous structure. Higher proportions of binder will enable higher amounts of these complex ions to be impregnated. Thus, suitable platinum compounds include chloroplatinic acid and various compounds containing the platinum and amine complex. Phosphorus is generally also present in the fully formulated catalyst, as phosphorus is often used in solutions from which base metals, such as nickel, tungsten and molybdenum, are impreganted onto the catalyst.

Base metal components, especially nickel-tungsten and nickel-molybdenum are particularly preferred in the present process.

Process Configuration

The process is illustrated schematically in the drawing. A gas oil or resid feed to an FCC unit 10 is cracked in the FCC unit and the cracking products are fractionated in the cracker fractionator 11 to produce the various hydrocarbon fractions which leave the fractionator in the conventional manner. A full range light cycle oil (FRLCO) is withdrawn from fractionator 11 through draw-off conduit 12 and is subjected to a secondary fractionation in distillation tower 13. the lower boiling fraction with a typical boiling range of 300°-650° F. (150°-345° C.), preferably 330°-600° F. (165°-315° C.), is withdrawn through conduit 14 and this light cut LCO (LCLCO) is then passed to hydrotreater 15 which forms the first stage of the hydrocracking unit. Alternately this fractionation can be done on the main FCC column itself. The higher boiling fraction of the cycle oil withdrawn from the bottom of fractionator 13 may be blended into fuel oil products in the conventional way, either directly or after CHD treatment. Although, as explained below, the hydrotreater is not necessary—and, for that reason, is not preferred—it is shown here as an optional feature of the entire process configuration. The LCLCO is hydrotreated in unit 15 to effect some aromatics saturation and to hydrogenate residual heteroatoms, especially nitrogen and sulfur, which are removed in interstage separator 16 as ammonia hydrogen sulfide together with excess hydrogen which is returned, after purification, in the hydrogen circuit line 17. The interstage separation and gas purification may not be necessary, considering the generally low heteroatom content of these feeds, but is shown here as an optional feature. The hydrotreated cycle oil then passes to hydrocracker 18 which forms the second state of the unit in which the saturation of the aromatics continues and ring opening and cracking take place to form a hydrocracked product which is rich in monocyclic aromatics in the gasoline boiling range. After hydrogen separation in separator 19, the hydrocracker effluent is fractionated in the conventional manner in distillation tower 20 to form the products including dry gas, gasoline, middle distillate and a bottoms fraction which may be withdrawn and blended into low sulfur fuel oil, or optionally recycled to FCCU 10 through recycle conduit 21. The gasoline range product from tower 20 is of high octane rating and is suitable for being blended directly into the refinery gasoline product pool without reforming or other treatment to improve octane number.

Hydrocracking Conditions

A single stage operation without preliminary hydrotreating is preferred since the LCLCO used in the present process contains relatively small proportions of polynuclear aromatics (PNAS) as well as of nitrogen and sulfur containing impurities which can all be handled adequately in a single stage operation. The bulk of the PNA's remain in the higher boiling portion of the cycle oil together with the bulk of the heteroatoms and accordingly do not enter this process. During the hydrocracking the objective is to create monocyclic aromtics of high octane value from the aromatics in the LCLCO. Bcause the LCLCO contains principally bicyclic aromatics such as naphthalene, benzothiophene, etc., the degree of saturation during the hydrocracking step must be limited so as to avoid complete hydrogenation of these components. For this reason, relatively low to moderate hydrogen pressures are used, usually not more than 1000 psig (7000 kPa), with minimum pressures usually being about 400 psig (about 2860 kPa), with typical pressures in the range of 600–1000 psig about (4250–7000 kPa), with the exact pressure selected being dependent upon feed characteristics (aromatic and heteroatom content), catalyst stability and aging resistance and the desired product characteristics. Similarly, because ring opening is also to be limited in order to preserve the aromatic character of the gasoline product, severity (temperature, residence time, conversion) is also limited. Conversion to 385° F.–(195° C.–) gasoline should be below 80 volume percent and preferably below 65 volume percent. Although conversion may exceed 75 volume percent, conversion levels between 55 and 70 volume percent are preferred. Because the absence of heteroatoms and PNAs from the feed reduces catalyst deactivation from heteroatom and PNA induced inhibition and coking, there is a reduced degree of necessity to relate conversion to hydrogen pressure as with the FRLCO feed (see application Ser. No. 825,294). Pressures between 400 and 1000 psig (2860–7000 kPa), usually in the range 600–1000 psig (4250–7000 kPa) with conversions up to 70 volume percent are preferred. Hydrocracking temperatures are typically up to 850° F. (450° C.) although higher temperatures up to about 900° F. (480° C.) may be employed, commonly with temperature minima of about 600° F. (315° C.) or higher, e.g. 700° F. (370° C.) being a recommended minimum. Space velocity will vary with temperature and the desired level of conversion but will typically be 0.25–2.5 hr.$^{-1}$, more usually 0.5–1.5 hr.$^{-1}$ (LHSV, 20° C.). Hydrogen circulation rates of 500–5000 SCF/Bbl (90–900 n.l.l.$^{-1}$) are suitable.

Hydrotreating

Although, as stated above, the use of two-stage hydrocracking, i.e. hydrotreating followed by hydrocracking is generally not preferred since it represents a needless complication and expense, it may be resorted to if desired, e.g. to use existing equipment and catalyst loadings. Preliminary hydrotreating may be carried out with or without interstage separation before the hydrocracking step. If interstage separation is omitted, i.e. cascade operation is employed, the hydrotreating catalyst may simply be loaded on top of the hydrocracking catalyst in the reactor.

Hydrotreating may be useful if the feed has a relatively high heteroatom content since hydrotreating with interstage separation of inorganic nitrogen and sulfur will enable extended cycle life to be obtained in the hydrocracking unit.

The hydrotreating catalyst may be any suitable hydrotreating catalyst, many of which are commercially available. These are generally constituted by a metal or combination of metals having hydrogenation/dehydrogenation activity and a relatively inert, i.e. non-acidic refractory carrier having large pores (20 Å or more). Suitable carriers are alumina, silica-alumina or silica and other amorphous, large pore size amorphous solids such as those mentiond above in connection with the hydrocracking catalyst binder materials. Suitable metal components are nickle, tungsten, cobalt, molybdenum, vanadium, chromium, often in such combinations as cobalt-molybdenum or nickel-cobalt-molybdenum. Other metals of Groups VI and VIII of the Periodic Table may also be employed. About 0.1–20 wt percent metal, usually 0.1–10 wt. percent, is typical.

Because the catalyst is relatively non-acidic (although some accidity is necessary in order to open heterocyclic rings to effect hetero atom removal) and because temperature is relatively low, conversion during the hydrotreating step will be quite low, typically below 10 volume percent and in most cases below 5 volume percent. Temperatures will usually be from 600° to 800° F. (315°–425° C.), mostly from 625° to 750° F. (330° to 400° C.). Space velocity (LHSV at 20° C.) will usually be from 0.25 to 4.0 hr.$^{-1}$, preferably 0.4 to 2.5 hr.$^{-1}$, the exact space velocity selected being dependent on the extent of hydrotreating desired and the selected operational temperature. Hydrogen pressures of 200–1000 psig (1500–7000 kPa), preferably 400–800 psig (2860–5620 kPa) are typical with hydrogen circulation rates of 500–5000 SCF/Bbl (90–9000 n.l.l.$^{-1}$) being appropriate. If cascade operation is employed, the hydrotreating pressure will be slightly higher than that desired in the hydrocracking step to allow for bed pressure drop.

The hydrotreating catalyst, like the hydrocracking catalyst, may be disposed as a fixed, fluidized, or moving bed of catalyst, although a downflow, fixed bed operation is preferred because of its simplicity.

When a preliminary hydrotreatment is employed, conditions in the hydrocracking step may be adjusted suitably to maintain the desired overall process objective, i.e. incomplete saturation of aromatics with limited ring opening of hydroaromatic components to form high octane gasoline boiling range products. Thus, if some saturation of bicyclic aromatics such as naphthalene, methyl naphthalenes and benzothiophenes is taken in the hydrotreating step, hydrogen consumption in the hydrocracking step will be reduced so that a lower temperature will result if space velocity is kept constant (since the extent of the exothermic hydrogenation reactions will be less for the same throughput in the second stage). In order to maintain the desired level of conversion (which is dependent on temperature, it may be necessary to decrease space velocity commensurately.

Hydrocracker Products

As described above, the objective of the present process is to produce a high octane gasoline directly. The boiling range of the gasoline will typically be $C_5$–385° F. ($C_5$–196° C.) (end point) but gasolines of higher or lower end points ay be encountered, depending on applicable product specifications, e.g. $C_5$–330° F. ($C_5$–165° C.) (end point) or $C_5$–450° F. ($C_5$–232° C.). Minimum target octane number is 85 clear or higher, e.g. 87 (RON+0). In most cases, higher octane ratings are attainable, for example, clear ratings of at least 90 or higher, e.g. 95. In favorable cases, clear octane ratings of 100 or higher may be attained. In all cases, the gasoline boiling range product may be blended directly into the refinery gasoline pool without reforming or other treatment to improve octane. As mentioned above, the hydrocracker bottoms fraction may be recycled to the catalytic cracking unit where its enhanced crackability as a consequence of its increased hydrogen content will further improve the total gasoline yield, this time by increasing the yield from the cracker. The hydrocracker bottoms may also be combined with the high boiling cut of the cycle oil (from fractionator 13) after it has been hydrotreated, e.g. in a conventional CHD unit to form a fuel oil or diesel fuel or, alternatively, the combined stream can be recycled to the FCCU, as previously described.

The present process is notable for the production of high octane gasoline directly from the highly aromatic product from the catalytic cracking unit. The use of lower hydrogen pressure and moderate processing conditions in the hydrocracker enables this result to be achieved with low hydrogen consumption and low utility requirements.

The invention is illustrated in the following Examples.

EXAMPLES 1–4

These Examples illustrate the benefits of fractionating the LCO feedstock prior to low pressure hydrocracking. Table 3 provides the properties of various cuts of LCO processed:

TABLE 3

| | LCO Properties | | | |
|---|---|---|---|---|
| LCO Cut | 385°–725° F. (Full Range) | 385°–550° F. (550° F.−) | 385°–640° F. (640° F.−) | 550°–725° F. (550° F.+) |
| Wt. pct of FRLCO | 100 | 42 | 70 | 58 |
| Gravity, API° | 11 | 15.9 | 15.0 | 6.9 |
| Sulfur, wt. pct. | 3.1 | 2.97 | 2.88 | 3.39 |
| Hydrogen, wt. pct. | 9.1 | 9.33 | 9.38 | 8.21 |
| Nitrogen, ppmw | 650 | 60 | 140 | 1000 |
| Aromatics, wt. pct. | 80 | 86 | 72 | 83 |

The various cuts of LCO shown in Table 3 were charged to a two reactor HT/HC system operating in the cascade mode. The first reactor contained a conventional $NiMo/Al_2O_3$ hydrotreating catalyst. The second reactor contained an equal volume of a hydrocracking catalyst comprising 1 to 3% palladium impregnated on dealuminized zeolite Y (De-AlY).

The conditions employed for the hydrotreating-hydrocracking were as shown in Table 4 below together with the results obtained.

TABLE 4

| | HT-HC of LCO | | | |
|---|---|---|---|---|
| Example No. | 1 | 2 | 3 | 4 |
| LCO Cut | FRLCO | 550° F.− | 640° F.− | 550° F.+ |
| HT Unit | | | | |
| Temp, °F. (°C.) | 675(357) | 670(354) | 675(357) | 680(360) |
| $H_2$ Press, psig (kPa) | 600 (4250) | 600 (4250) | 600 (4250) | 600 (4250) |
| $H_2$/Oil ratio, SCF/Bbl (n.l.l.$^{-1}$) | 5000 (890) | 5000 (890) | 5000 (890) | 5000 (890) |
| LHSV, hr.$^{-1}$ | 2 | 3 | 2 | 1 |
| HC Unit | | | | |
| Temp, °F. (°C.) | 775 (413) | 775 (413) | 775 (413) | 775 (413) |
| $H_2$/Oil ratio, SCF/Bbl (n.l.l.$^{-1}$) | 5000 (890) | 5000 (890) | 5000 (890) | 5000 (890) |
| LHSV, hr.$^{-1}$ | 2 | 3 | 2 | 1 |
| Gasoline, Vol % ($C_5$–385° F., $C_5$–196° C.) | 21 | 45 | 35 | 12 |
| RON + O | 94 | 98 | 97 | 92 |

As can be seen from Table 5, the 550° F.−(290° C.−) and 640° F.−(340° C.−) fractions underwent substantially more conversion than the full range material, which in turn converted more than the 550° F.+(290° C.+) LCO. In addition, the octane numbers of the gasoline from the 550° F.−(290° C.−) and 640° F. (340° C.−) fractions were higher.

The second stage and overall LHSVs were higher (so that severity was lower) for the lower boiling fractions, yet the conversions actually attained were also higher. Thus, the low pressure hydrocracking of the light cut, fractionated LCO produced more gasoline at higher octane using lower severity conditions than the full range LCO.

EXAMPLE 5

The present process concept on a commercial scale would involve fractionation of the LCO in a higher boiling fraction (with a 5% point ranging from 550°–700° F. (290°–370° C.), followed by hydotreatment (CHD) of the higher boiling fraction. Low pressure hydrocracking of the lower boiling fraction is used to produce the high octane gasoline. Hydrotreating of the higher boiling fraction would proceed by charging the higher boiling LCO fraction alone, or as a mixture of the LCO with a virgin kerosene stream, to a catalytic desulfurization (CHD) unit. Table 5 shows conditions and results of such an operation, compared to LPHC of a full range LCO:

TABLE 5

| Full Range vs. Split Stream LPHC | | |
|---|---|---|
| Feed | Full Range | LCO Fractionated at 550° F. E.P. (290° C. E.P.) |
| Overall LHSV | 0.5 | 1.7 |
| Hydrogen Consumption | 1200 | 1160 |
| Product, Vol % | 2.4 | 3.7 |
| $C_4$'s | | |
| $C_5$–385° F. ($C_5$–195° C.) | | |
| Gaso | 20 | 21 |
| 385° F.+ Distillate, | 84 | 82 |
| Gaso. RON (+0) | 94 | 98 |
| 385° F.+ (195° C.+) | 8.6 | 10.9 |
| Diesel Index | | |

Note
Diesel Index is the product of Aniline Point (°F.) and API Gravity/100.

Table 5 shows that split stream hydrocracking produces more gasoline at higher octane and higher space velocity than full range LPHC. In addition, the unconverted 385° F.+ distillate is of better quality, as measured by the Diesel Index.

Thus, when the boiling point of a feedstock is held to a range of between 350° and 650° F. (175°–345° C.), a hydrocracking process can be operated at higher conversion levels and yet maintain a high octane level, selectivity and naphtha yield.

EXAMPLE 6

This example illustrates the suitability of certain LCLCO streams for processing in a single stage hydrocracking operation without prior hydrotreating. The feedstock in this Example is similar to that in the Example 5, as shown in Table 6 below.

TABLE 6

| LCO Cut | 385°–550° F. (550° F.–) LCLCO |
|---|---|
| Wt. pct. of LCO | 41 |
| Gravity, API | 17.1 |
| Sulfur, wt. pct. | 2.8 |
| Hydrogen, wt. pct. | 9.5 |
| Nitrogen, ppmw | 210 |
| Aromatics, wt. pct. | 83 |

In both cases, the second stage hydrocracking reactor contained a dealuminized zeolite Y catalyst impregnated with 3.8% Ni and 6.5% Mo. When used, the first reactor contained an equal volume of a conventional $NiMo/Al_2O_3$ hydrotreating catalyst. When the first reactor operation was discontinued, it was ncessary to reduce feed rate to maintain the same overall LHSV to obtain comparable levels of conversion. Results from these operations are shown in Table 7.

TABLE 7

| Conversion of 550° F.– LCLCO | | |
|---|---|---|
| | Cascade HDT/HDC | Single Stage HDC |
| Gasoline wt. pct. | 59.4 | 53.2 |
| RON + O | 100.6 | 102.4 |
| Overall LHSV | 0.5 | 0.5 |
| $H_2$ Consumption, SCF/Bbl | 1810 | 1750 |

Although the single stage operation shows a slightly lower gasoline yield, this can be compensated for by operating at a slightly higher temperature. Note also that for this particular feedstock there is an octane benefit of almost two numbers for the single stage operation.

We claim:

1. A process for producing a high octane gasoline, which comprises hydrocracking a highly aromatic, substantially dealkylated hydrocarbon feed having an initial boiling point of at least 300° F. and an end point of not more than 650° F., an aromatic content of at least 50 weight percent, an API gravity of not more than 25 and a hydrogen content not more than 12.5 weight percent at a hdyrogen partial pressure of not more than 1000 psig and a conversion of not more than 80 to gasoline boiling range products having an octane rating of at least 87 (RON+0).

2. A process according to claim 1 in which the feed has an aromatic content of at least 60 weight percent.

3. A process according to claim 1 in which the feed has an aromatic content of at least 70 weight percent.

4. A process according to claim 1 in which the feed has a hydrogen content of 8.5 to 12.5 weight percent.

5. A process according to claim 1 in which the feed has an API gravity not more than 20.

6. A process according to claim 1 in which the feed has an API gravity to 5 to 25.

7. A process according to claim 1 in which the hydrogen partial pressure is from 600 to 1000 psig.

8. A process according to claim 1 in which the conversion is not more than 55 to gasoline boiling range products.

9. A process according to claim 1 in which the hydrocracking is conducted in the presence of a large pore size hydrocracking catalyst having acidic and hydrogenation-dehydragenation functionality.

10. A process according to claim 9 in which the hydrocracking catalyst comprises a large pore size crystalline alumino silicate zeolite.

11. A process according to claim 10 in which the zeolite comprises a zeolite having the structure of zeolite Y.

12. A process according to claim 10 in which the zeolite comprises zeolite Y, zeolite USY, or zeolite De-AlY.

13. A process according to claim 12 in which the zeolite has an alpha value up to 100.

14. A process according to claim 9 in which the hydrogenation-dehydrogenation functionality is provided by a metal component comprising at least one of nickel, tungsten, vanadium, molybdenum, cobalt and chromium.

15. A process according to claim 9 in which the hydrogenation-dehydrogenation functionality is provided by a metal component comprising at least one of platinum and palladium.

16. A process according to claim 1 in which the portion of the hydrocracked product boiling above the gasoline boiling range is passed to a catalytic cracking operation.

17. A process according to claim 1 in which the hydrocracked, gasoline boiling range product has an octane rating of at least 90.

18. A method according to claim 1 in which the feed is hydrotreated before being hydrocracked.

19. A method for the production of a high octane, hydrocracked gasoline, which comprises hydrocracking a highly aromatic light cut light cycle oil of the following properties:

API°: not more than 25
Boiling range: 300°–650° F.
Hydrogen content: 8.5–12.5 wt. pct.
Aromatic content: at least 60 wt. pct. under the following conditions:

Temperature 700°–850° F.

$H_2$ partial pressure 600–1000 psig in the presence of a hydrocracking catalyst comprising an aromatic-selective, large pore size crystalline, aluminosilicate zeolite having acidic functionality with an alpha value up to 100, and a metal component providing hydrogenation-dehydrogenation functionality, to form a hydrocracked gasoline boiling range product having an octane number of at least 87 (RON+0).

20. A process according to claim 19 in which the zeolite is zeolite Y, zeolite USY or de-AlY.

21. A process according to claim 19 in which the metal component of the hydrocracking catalyst comprises at least one of nickel, tungsten, molybdenum, cobalt and vanadium.

22. A process according to claim 19 in which the conversion to gasoline boiling range products is 10 to 65 volume percent.

23. A process according to claim 19 in which the product gasoline has an octane number of at least 90 (RON+0).

* * * * *